US005131202A

United States Patent [19]

Ball

[11] Patent Number: 5,131,202

[45] Date of Patent: Jul. 21, 1992

[54] BUILDING BLOCK

[75] Inventor: Peter A. Ball, Malmesbury, England

[73] Assignee: ECC Construction Materials Limited, Austell, England

[21] Appl. No.: 616,233

[22] Filed: Nov. 19, 1990

[30] Foreign Application Priority Data

Nov. 20, 1989 [GB] United Kingdom ..... 8926160

[51] Int. Cl.[5] ..... E04C 1/00

[52] U.S. Cl. ..... 52/596; 52/609; 52/612

[58] Field of Search ..... 52/596, 609, 612

[56] References Cited

U.S. PATENT DOCUMENTS

| | | | |
|---|---|---|---|
| 1,676,153 | 7/1928 | Palmer | 52/612 |
| 2,629,135 | 2/1953 | Johnson | 18/60 |
| 3,426,122 | 2/1969 | Gaudelli et al. | 52/609 |
| 4,258,522 | 3/1981 | Amaral | 52/591 |

FOREIGN PATENT DOCUMENTS

| | | |
|---|---|---|
| 0015426 | 2/1980 | European Pat. Off. . |
| 0030510 | 12/1980 | European Pat. Off. . |
| 0101062 | 8/1983 | European Pat. Off. . |
| 0126507 | 5/1984 | European Pat. Off. . |
| 0227144 | 11/1986 | European Pat. Off. . |
| 7308259 | 8/1973 | Fed. Rep. of Germany . |
| 8028909 | 5/1982 | Fed. Rep. of Germany . |
| 8134590 | 10/1982 | Fed. Rep. of Germany . |
| 8403953 | 5/1984 | Fed. Rep. of Germany . |
| 3507226 | 9/1986 | Fed. Rep. of Germany . |
| 1344995 | 1/1974 | United Kingdom . |

*Primary Examiner*—Richard E. Chilcot, Jr.
*Assistant Examiner*—Wynn Wood
*Attorney, Agent, or Firm*—Darby & Darby

[57] ABSTRACT

A building block, at least one face of which has a recessed surface along at least a portion of its periphery. The recessed surface is of non-uniform width and, at least in part, defines a surface of irregular shape. Each remaining face of the block has a surface of regular geometric shape facilitating laying of the block.

15 Claims, 5 Drawing Sheets

BUILDING BLOCK

BACKGROUND OF THE INVENTION

1. Field of the Invention

The present invention relates to a building block, and particularly, but not exclusively to a reconstructed stone building block, and has application in the construction of walls and paving having an irregular natural stone appearance.

2. Description of the Prior Art

To obtain the appearance of traditional stone walling or paving, it is at present necessary to build a wall or paving of irregular pieces of stone. Laying such stone is a skilled and hence expensive procedure.

BRIEF SUMMARY OF THE INVENTION

It is an object of the present invention to provide a building block which enables the construction, by normal bricklaying techniques, of a wall or paving having the appearance of having been built from irregular pieces of stone.

According to the present invention there is provided a building block wherein at least one face of the block has a recessed surface of non-uniform width along at least a portion of the periphery thereof defining, at least in part, a surface of irregular shape, and at least one of the remaining faces of the block has a surface of regular geometric shape.

Preferably, each of the remaining faces of the block has a surface of regular geometric shape. A preferred embodiment of such a block has at least two adjacent surfaces of regular geometric shape.

In another preferred embodiment intended for location in the body of a wall, at least the top and bottom faces of the block have a surface of regular geometric shape.

In a further embodiment of the invention, two adjacent faces of the block have irregular shaped surfaces. Such blocks having a front face and an end face with irregularly shaped surfaces, are intended for use at the end or corner of a wall, although they may also be used in the body of the wall. In a another embodiment of the invention a front face and two adjacent faces, for example, the two end faces, have irregularly shaped surfaces.

In a further embodiment of the present block intended for location in the body of a wall or for use in paving, a single face of the block has said surface of irregular shape. In the case of the block for walling, that face is a front face whereas in that for paving, the face is a top face of the block.

Each irregularly shaped surface is preferably textured in order to give the appearance of natural or "rough dressed" stone. In a preferred embodiment, the depth of the irregularly shaped surface with respect to its respective recessed surface varies across the width and/or breadth of the corresponding face.

Each surface of the block which is of regular geometric shape is preferably rectangular and flat in conventional fashion.

The present blocks are preferably constructed by moulding, the mould being conventional except for the provision of a recess or irregular rebate in one or more faces, as required, to define the irregularly shaped surface(s).

BRIEF DESCRIPTION OF THE ACCOMPANYING DRAWINGS

Preferred embodiments of the present invention will now be described, by way of example, with reference to the accompanying drawings, in which:

FIGS. 1*a* to 1*m* are sketches illustrating the "front faces" of building blocks according to embodiments of the present invention;

FIG. 2 shows a portion of the "front face" of an embodiment of a building block according to the invention;

FIG. 3 a cross-section of the building block illustrated in FIG. 2;

FIGS. 4*a* to 4*c* show various perspective views of a further embodiment of the present invention;

FIG. 5 is a sketch in plan of the "front face" of an embodiment similar to in FIGS. 4*a* to 4*c;*

FIGS. 6*a* and 6*b* are sketches indicating possible alternative forms of the embodiment illustrated in FIGS. 4*a* to 4*c* , and FIGS. 7*a* and 7*b* are perspective views of a further embodiment of the present invention, respectively of one side from above and of the other side from below.

DETAILED DESCRIPTION OF PREFERRED EMBODIMENTS OF THE INVENTION

In the embodiments illustrated in the accompanying drawings, the building block may be considered to consist of a rectangular block 1 having an irregularly shaped protruding surface 2, (2*a*) on at least one face 3, (3*a*). Where the protruding surface 2, (2*a*) falls short of the rectangular form of its respective face 3, (3*a*) of block 1, there is a recessed peripheral surface 4, (4*a*).

Figure 1:
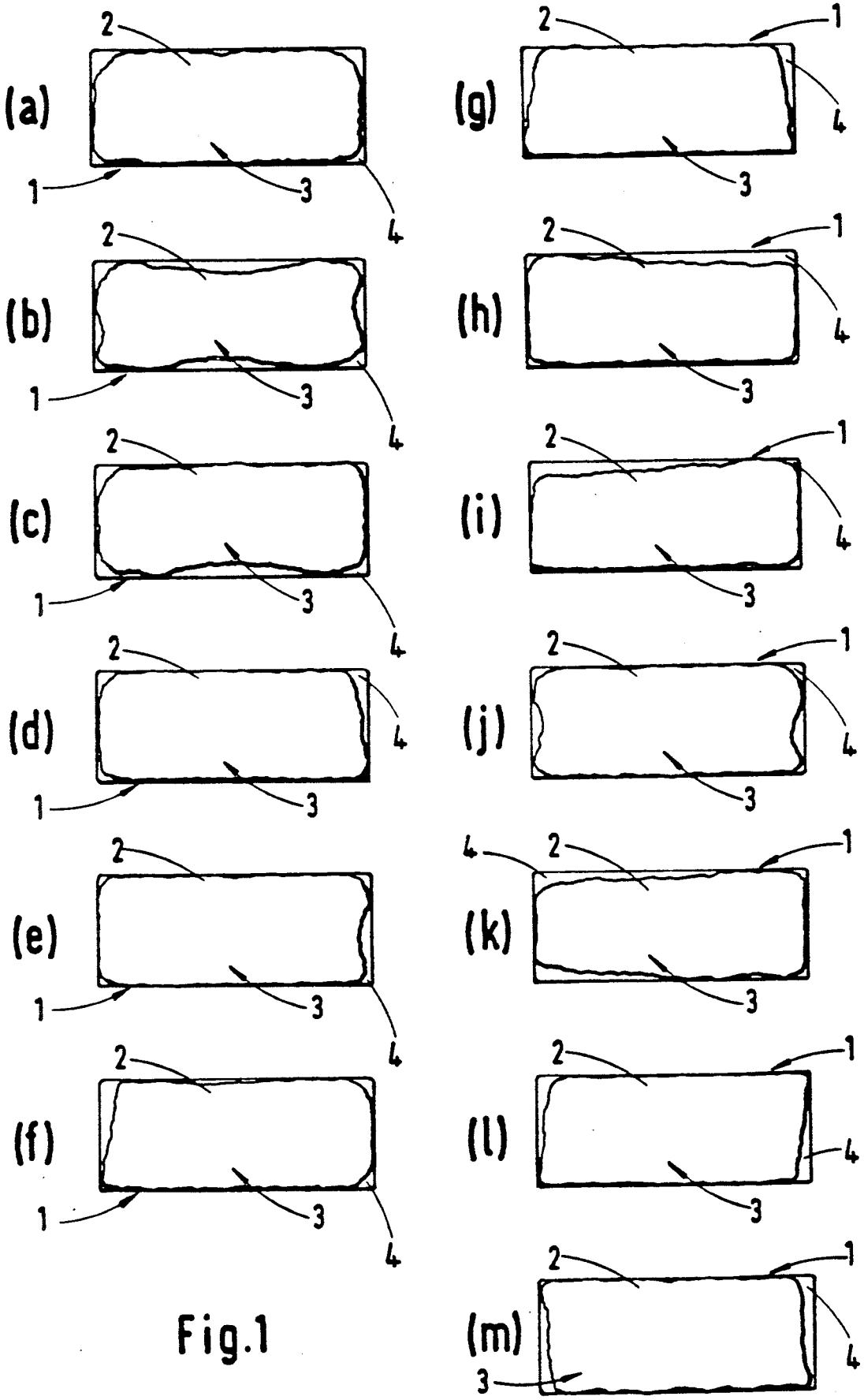
Figure 2:
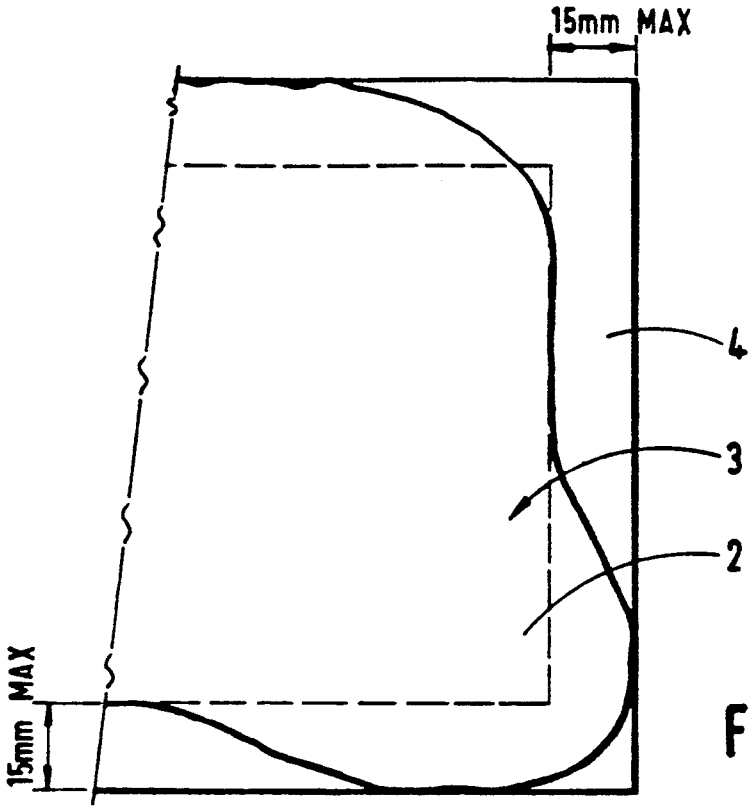
Figure 3:
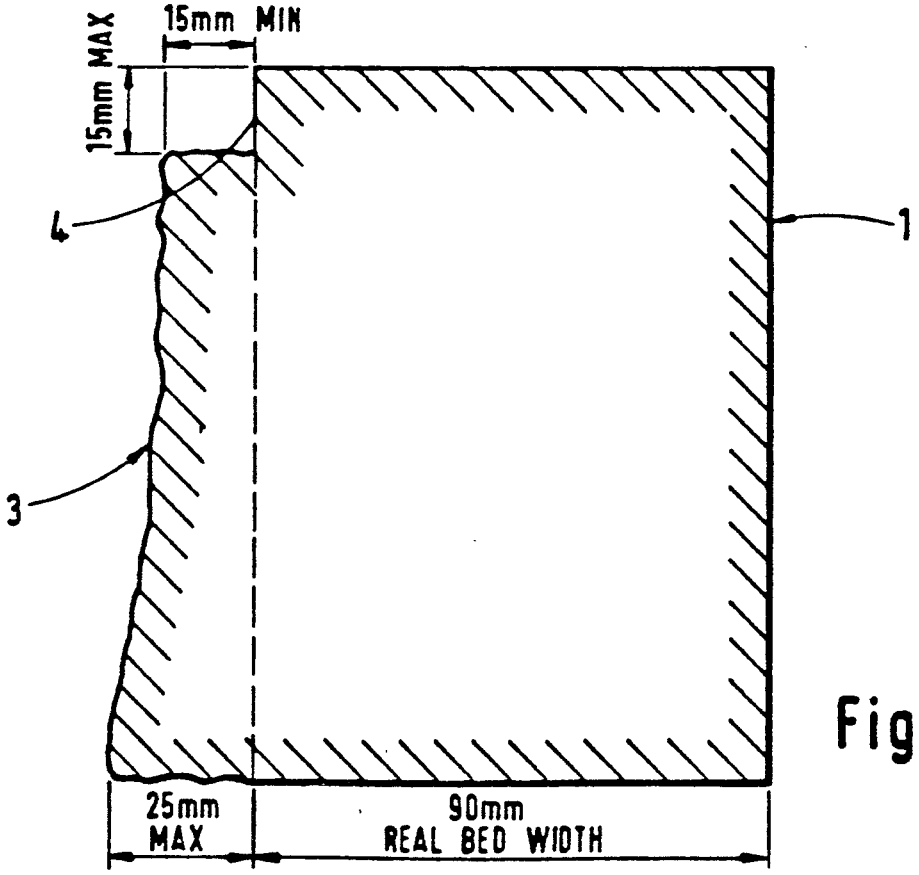

In the embodiment shown in FIGS. 1 to 3, the protruding irregularly shaped surface is provided only on the "front face" of the block. Such blocks are intended for location in a wall where only their "front face" is visible. It is clear from FIGS. 1*a* to 1*m* that the protruding surface 2 may take any number of shapes.

FIGS. 2 and 3 illustrate preferred dimensional criteria for the protruding and recessed surfaces 2, 4, respectively. As illustrated by a dotted line in FIG. 2, the maximum width permitted for the recessed surface 4 is constant along the entire periphery of the block. For this embodiment the width of the recessed surface varies from 0 to 15 millimeters.

FIG. 3 shows the protruding surface 2 to have both a minimum and a maximum depth with respect to the recessed surface 4. In the present case of a block having a "bed width" of 90 millimeters, the depth of the protruding surface is in the range of 15 to 25 millimeters.

Figure 4A:
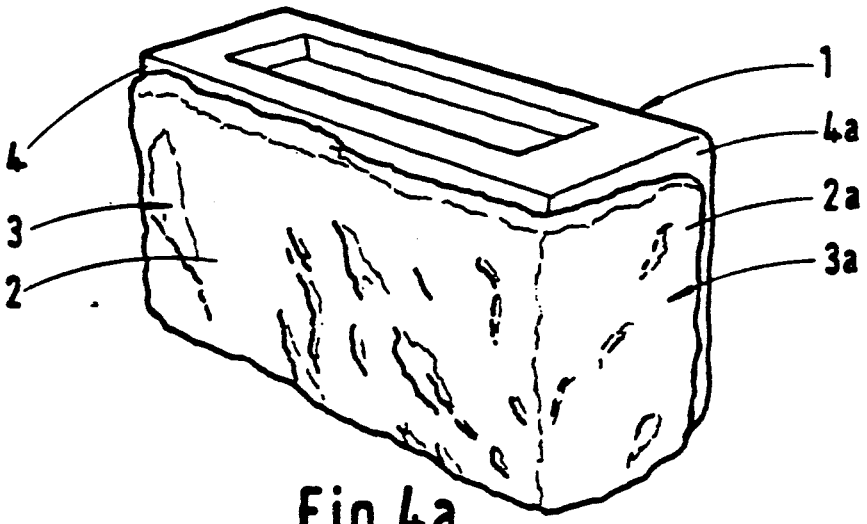
Figure 4B:
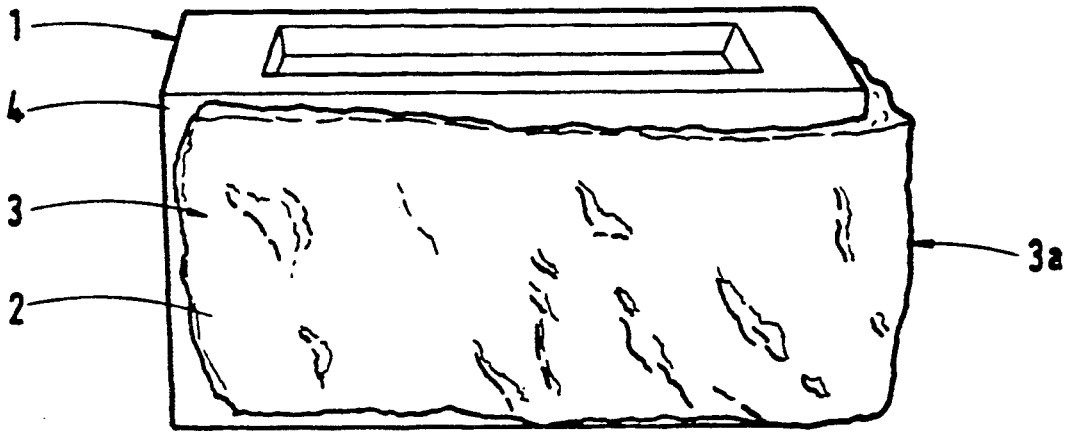
Figure 4C:
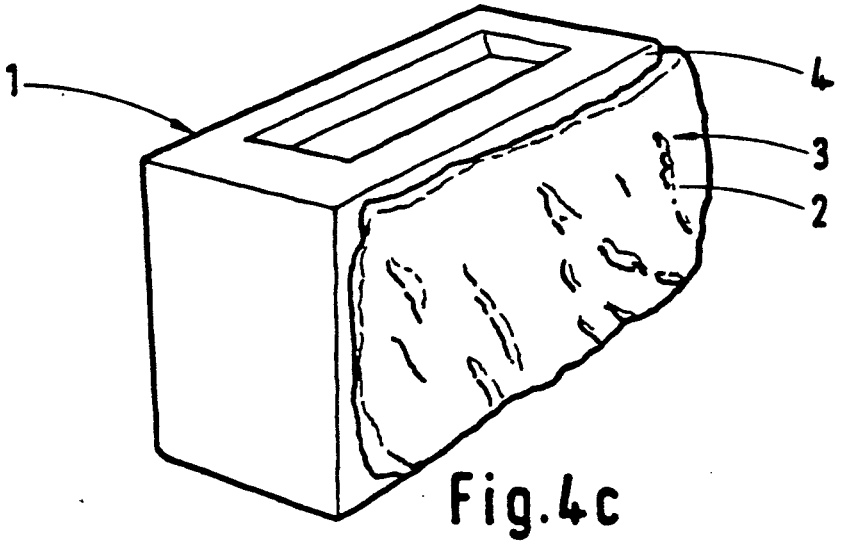

FIGS. 4*a* to 4*c* illustrate a building block intended for use at the end or corner of a wall. In this case, one end face 3*a* adjacent the front face 3, is also provided with a protruding surface 2*a* which is continuous with that on the front face.

Figure 5:
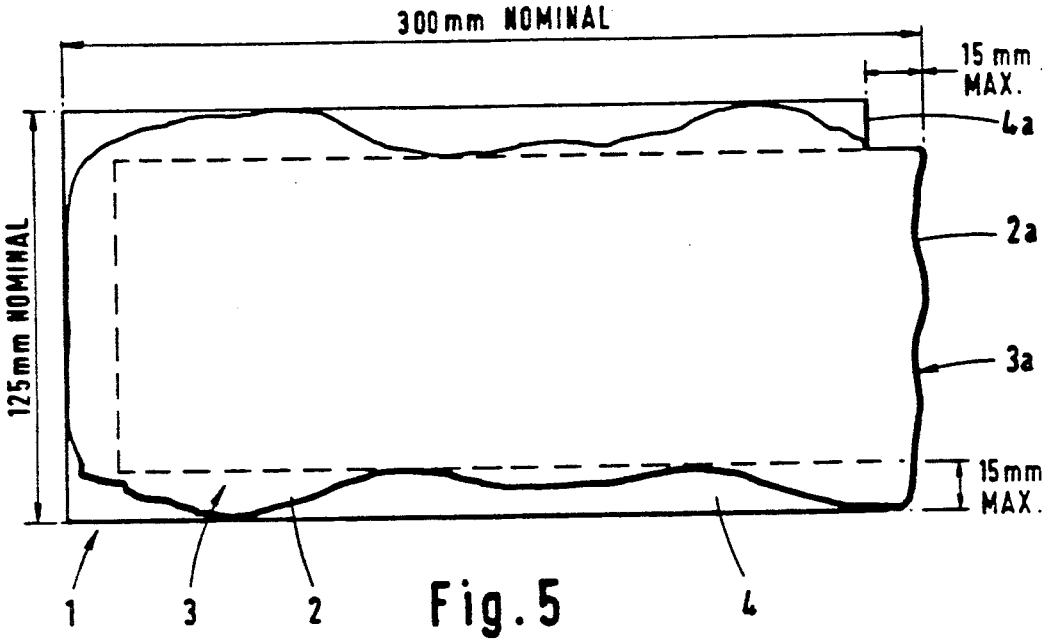
Figure 6A:
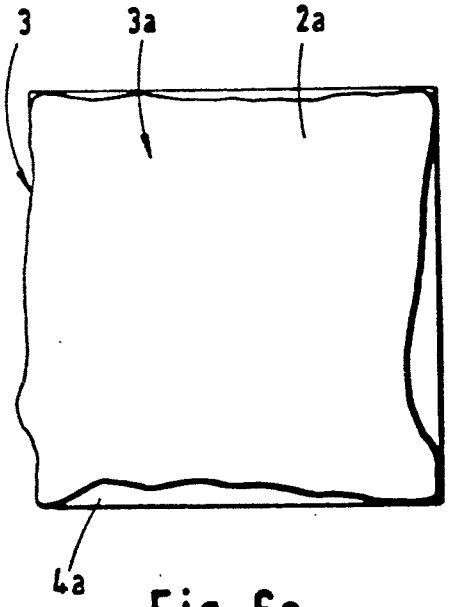
Figure 6B:
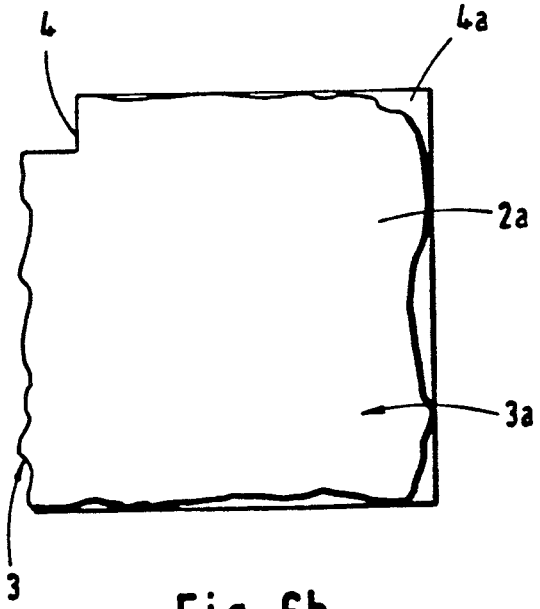

The dimensional criteria for the protruding and recessed surfaces 2*a*, 4*a* is the same as discussed in relation to FIGS. 2 and 3 and is further illustrated in FIG. 5. FIGS. 6*a* and 6*b* illustrate, by way of example, alternative shapes for the protruding surfaces 2*a* on the end of the building block taking this criteria into account.

As may be seen from FIGS. 4*a* to 4*c*, those faces of the blocks which do not have a protruding surface and are intended to abut an adjacent block and to form plain reveals to windows and door openings, are rectangular and are either flat or are provided with a recess in conventional fashion. This enables a wall to be built up from a plurality of such blocks employing conventional brick laying techniques. The blocks can be located easily in position using normal consistent bed-to-bed and end-to-end spacing for cement mortar in filling, while providing a wall surface having the appearance of a plurality of irregular shaped blocks and varying joint size. This irregular pattern of the finished wall surface is produced by the irregular space created between the edges of the projecting surfaces of adjacent blocks due to the variation in the width of the recessed surfaces. This irregular pattern is considerably enhanced if the wall is built from blocks having projecting surfaces of differing profiles. Having said this, an irregular effect can still be achieved by using a plurality of blocks having a single protruding surface profile design, provided that the orientation of the block is varied across the wall surface.

As already mentioned, the block shown in FIGS. 4 to 6 is intended for use at each end of a course of blocks to give the wall ends the same irregular and random appearance as the front surface of the wall. However, it will be appreciated that such blocks can also be used in the body of the wall in the normal course of laying.

In a completed wall, the space created between the protruding surfaces of adjacent blocks will be filled with cement or mortar to a depth which depends on the degree of natural finish required. In the embodiments illustrated, if a random mix of blocks of different designs are laid, the apparent width of the "joint" created will vary from say 10 mm (the typical joint width between standard blocks) up to 40 mm (that is 10 mm plus 15 mm for each of the two surfaces).

Typical dimensions of the blocks as defined by their non-recessed faces are:

height: 75, 100, 125 and 150 mm, length: 200, 225, 250, 275, 300 and 325 mm, depth: 90 to 105 mm.

However, it is emphasised that these dimensions are given only by way of example, and the building block of the present invention may have any dimensions desired. Further, it will be understood that the criteria for the width of the recessed surface and depth of the protruding surface described above in relation to FIGS. 2, 3 and 5 may be varied as appropriate to the size of the block and the overall finished effect desired.

The present blocks are preferably formed by moulding employing what would otherwise be a standard rectangular block mould, in which, in the case of the embodiments illustrated in is formed in the mould base to provide the desired projecting surface 2. In the case of blocks such as those illustrated in FIGS. 4 to 6, this recess extends into an adjacent end wall of the mould to provide the projecting surface 2*a*.

The building blocks of the present invention are preferably made from naturally occurring aggregates, such as, for example, sand, together with cement and colouring pigments.

Figure 7A:
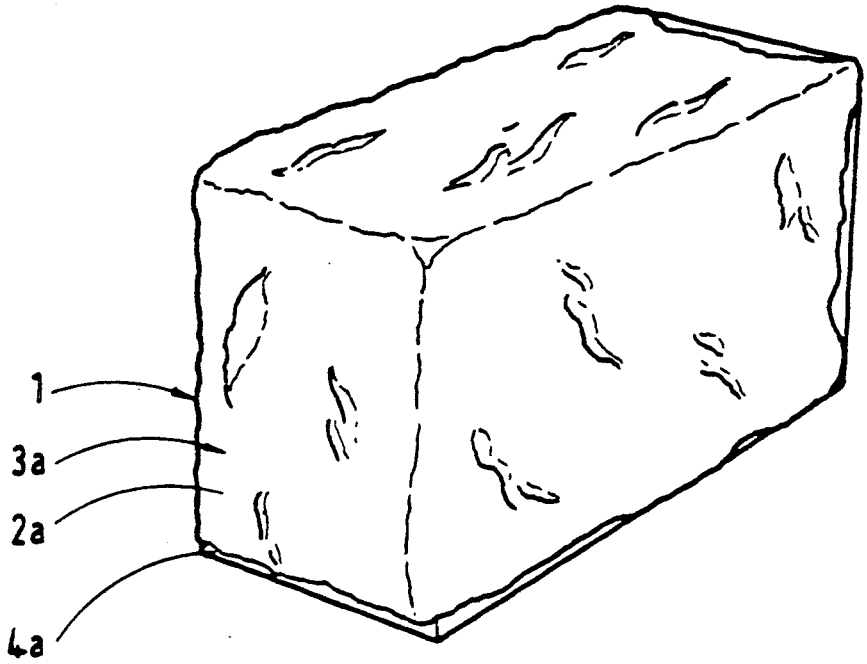
Figure 7B:
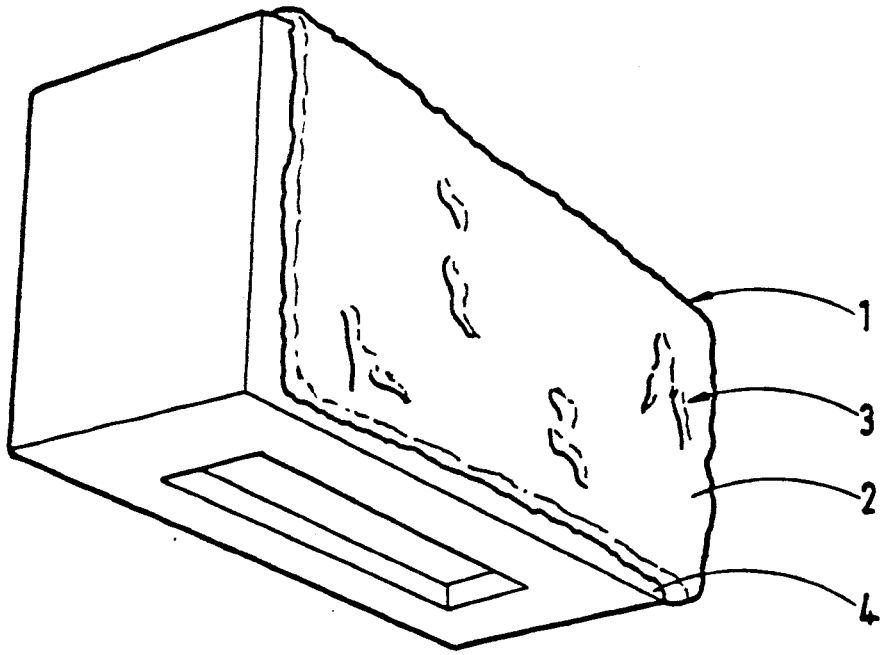

It will be appreciated that irregularly shaped projecting surfaces may also be provided on other surfaces of the block, as required. For example, for those blocks intended for the top course of a wall or as coping stones, it may well be desired to provide a projecting surface on the "top" of the block which extends from that on the front and, as applicable, also from that on the end of the block. Blocks may also be provided with a projecting surface on that face opposite the "front face", for use in building walls to be viewed from both sides. FIGS. 7*a* and 7*b* illustrate an embodiment of a block having a projecting surface on all surfaces but two, for location at one end of the top course of a wall to be viewed from both sides.

Furthermore, an embodiment is envisaged in which the surface of only one face namely, the base, is of regular geometric shape. This is for use in forming the top course of a wall or as a coping stone. In this case, the face opposite that of regular shape will not have a recessed peripheral surface (4).

The above description of embodiments of the present invention has been with reference to the construction of walls. However, embodiments of the present invention may also be used in the construction of paving. In such an application, as with walling, the provision of at least one face having a surface of regular geometric shape facilitates laying by conventional techniques. In a preferred embodiment consisting of a paving stone or slab, only the top surface has the irregular shaped protruding surface (2) (See FIG. 1), the remainder being of regular geometric shape. Curb stones or edgings for paving have a protruding surface on at least the top and an adjacent face, whereas corner stones have a protruding surface on the top and two adjacent side faces.

I claim:

1. A building block for constructing walling using brick laying techniques employing mortar or cement, which block has a plurality of faces, and comprises:

a surface of irregular shape in plan on at least one of said faces;

a recessed surface for receiving mortar or cement, which recessed surface is of non-uniform width along at least a portion of the periphery of said at least one of said faces, defining, at least in part, said surface of irregular shape, and a surface of regular geometric shape on at least one of those faces remaining.

2. A building block as claimed in claim 1 wherein each of the remaining faces of the block has a surface of regular geometric shape.

3. A building block as claimed in claim 1 wherein at least two adjacent faces of the block have a surface of regular geometric shape.

4. A building block as claimed in claim 1, wherein at least two opposite faces of the block have a surface of regular geometric shape.

5. A building block as claimed in claim 1, wherein two adjacent faces of the block have said irregular shaped surface.

6. A building block as claimed in claim 1, wherein a front face and one end face have said irregular shaped surface.

7. A building block as claimed in claim 1, wherein a single face of the block has said surface of irregular shape.

8. A building block as claimed in claim 1, wherein said irregular shaped surface is textured, giving the appearance of stone.

9. A building block as claimed in claim 1, wherein the depth of said irregular shaped surface with respect to the associated recessed surface, varies across the corresponding face.

10. A building block as claimed in claim 9, wherein the depth of said irregular shaped surface with respect to the associated recessed surface, varies across the width of the corresponding face.

11. A building block as claimed in claim 9, wherein the depth of said irregular shaped surface with respect to the associated recessed surface varies across the breadth of the corresponding face.

12. A building block as claimed in claim 1, wherein said surface of irregular shape has a depth with respect to the associated recessed surface of in the range of 15 to 25 millimeters.

13. A building block as claimed in claim 1, wherein said surface of regular geometric shape is rectangular.

14. A building block as claimed in claim 1 wherein said surface of regular geometric shape has a centrally located recessed portion.

15. A building block as claimed in claim 1, wherein the maximum width of said recessed surface is 15 millimeters.

* * * * *